US011696630B1

(12) United States Patent
Liu

(10) Patent No.: US 11,696,630 B1
(45) Date of Patent: Jul. 11, 2023

(54) LIPSTICK CONTAINER WITH A REPLACEABLE LIPSTICK

(71) Applicant: Zhuhai Ding Rong Plastic Products Co., LTD., Zhuhai (CN)

(72) Inventor: Ting Nan Liu, New Taipei (TW)

(73) Assignee: Zhuhai Ding Rong Plastics Products Co., LTD., Zhuhai (CN)

( * ) Notice: Subject to any disclaimer, the term of this patent is extended or adjusted under 35 U.S.C. 154(b) by 0 days.

(21) Appl. No.: 17/839,672

(22) Filed: Jun. 14, 2022

(51) Int. Cl.
*A45D 40/04* (2006.01)
*A45D 40/06* (2006.01)
*A45D 40/00* (2006.01)

(52) U.S. Cl.
CPC ..... *A45D 40/06* (2013.01); *A45D 40/04* (2013.01); *A45D 2040/0031* (2013.01); *A45D 2040/0043* (2013.01)

(58) Field of Classification Search
CPC ..... A45D 40/04; A45D 40/14; A45D 40/16; A45D 2040/043; A45D 2040/0031; A45D 2040/0037
USPC ..... 401/68, 75, 171–174
See application file for complete search history.

(56) References Cited

U.S. PATENT DOCUMENTS 5,399,040 A * 3/1995 Holloway ..... A45D 40/06 401/86
8,328,445 B2 * 12/2012 Martins ..... A45D 40/16 401/78
11,129,463 B2 * 9/2021 Dinata ..... A45D 40/06

* cited by examiner

*Primary Examiner* — David J Walczak

(57) ABSTRACT

A lipstick container with replaceable lipstick includes a hollow cap including inner grooves; a lipstick carrier partially disposed in the cap and including a rotational seat, an axial snapping hole in the rotational seat, two opposite snapping members between the snapping hole and the rotational seat, two recesses each disposed between the snapping members, two axial projecting members each formed with the snapping member, and ridges on an outer surface; a joining device including an axial well, end projections, an annular protrusion, and inner troughs; a locking device including a seat having first and second annular surfaces; an axial shaft; two opposite protuberances; a toothed member on the second annular surface; and an axial projecting element; and a base including a grooved member, a toothed element on a bottom, and an axial through hole.

9 Claims, 7 Drawing Sheets

LIPSTICK CONTAINER WITH A REPLACEABLE LIPSTICK

FIELD OF THE INVENTION

The invention relates to lipstick containers and more particularly to a lipstick container with a replaceable lipstick so as to be environment friendly.

BACKGROUND OF THE INVENTION

Conventional lipstick containers are intended to be thrown away after the lipstick has been consumed. However, this is not environment friendly and may harm the environment.

For overcoming the drawbacks, the present inventor has invented a lipstick container with a replaceable lipstick. In detail, the lipstick container comprises a cover, a lipstick carrier, a joining device and a base. A snapping hole is provided at one end of the lipstick carrier. Two cavities are provided at two opposite portions of the snapping hole respectively. Two raised members are provided on an inner surface of the lipstick carrier and are away from the cavities. A shaft is provided on a bottom of the lipstick carrier. A flange is provided at either end of the shaft and extends radially. The flanges urge against the raised members respectively in a locked position. A rotation of the base can disengage the shaft from the lipstick carrier prior and the joining device to replace a consumed lipstick with a new one.

However, the lipstick container has the following disadvantage: The shaft and the base are formed integrally by means of ultrasonic welding or adhesive. This is not environment friendly and may harm the environment.

Thus, the need for improvement still exists.

SUMMARY OF THE INVENTION

It is therefore one object of the invention to provide a lipstick container with a replaceable lipstick comprising a cap including an internal space and a plurality of grooves on an inner surface adjacent to its opening; a lipstick carrier partially disposed in the internal space and including a rotational seat at an end distal the cap, a snapping hole axially disposed in the rotational seat, two opposite snapping members disposed between an edge of the snapping hole and the rotational seat, two recesses each disposed between the snapping members, two axial projecting members each formed with the snapping member and adjacent to the recess, and a plurality of ridges formed on an outer surface of the rotational seat; a joining device including an axial well, a plurality of end projections spaced apart on an outer surface of an end of the joining device, the projections being configured to secure to the grooves, an annular protrusion at an end of the joining device opposite to the projections, and a plurality of longitudinal troughs on an inner surface of the joining device adjacent to the protrusion, the troughs being configured to secure to the ridges; a locking device including a seat having a first annular surface at one end and a second annular surface at the other end; an axial shaft extending from the first annular surface and disposed through the well of the joining device; two opposite protuberances radially extending from an outer surface of the shaft and urging against the projecting members of the lipstick carrier respectively; a toothed member formed on the second annular surface; and an axial projecting element extending from the toothed member; and a base including a grooved member on an inner surface urging against an outer surface of the protrusion, a toothed element on a bottom and being in gear engagement with the toothed member and urging against the second annular surface, and an axial through hole disposed through both an end of the base and the toothed element with the projecting element disposed therein.

In addition, an annular groove is formed between the protuberances and the first annular surface. A washer is disposed on the annular groove; engaged with the first annular surface, and urging against the snapping members.

The invention has the following advantages and benefits in comparison with the conventional art:

Decreased manufacturing cost and increased production efficiency. The toothed element is gear engagement with the toothed member and the projecting element is disposed in the through hole. Thus, the locking device and the base are secured together. This is contrast to the conventional art which has its locking device and the base formed integrally by means of ultrasonic welding or adhesive. This not only greatly decreases the manufacturing cost but also increases the production efficiency.

Prolonged useful life. The washer is disposed on the annular groove and is engaged with the first annular surface. The washer urges against the snapping members so that the locking device can increase tightness with the lipstick carrier when the lipstick carrier is rotated. Otherwise, the lipstick carrier may be loosened. With the provision of the washer, the snapping members do not contact the seat. This can decrease wear of both the lipstick carrier and the locking device and prolong the useful life of both the lipstick carrier and the locking device.

Easy lipstick replacement and environment friendly. A user may hold the joining device and clockwise rotate the base so as to rotate the locking device. Thus, the protuberances move from a position engaging the projecting members to a position in the recesses. The lipstick carrier is unlocked. Then the user may lift the lipstick carrier to disengage it from both the locking device and the well. Finally; the user may replace the consumed lipstick with a new one. Only the consumed lipstick is replaced rather than discarding the lipstick container. The lipstick container is reusable and environment friendly and does not harm the environment.

The above and other objects, features and advantages of the invention mill become apparent from the following detailed description taken with the accompanying drawings.

DETAILED DESCRIPTION OF THE INVENTION

Figure 1:
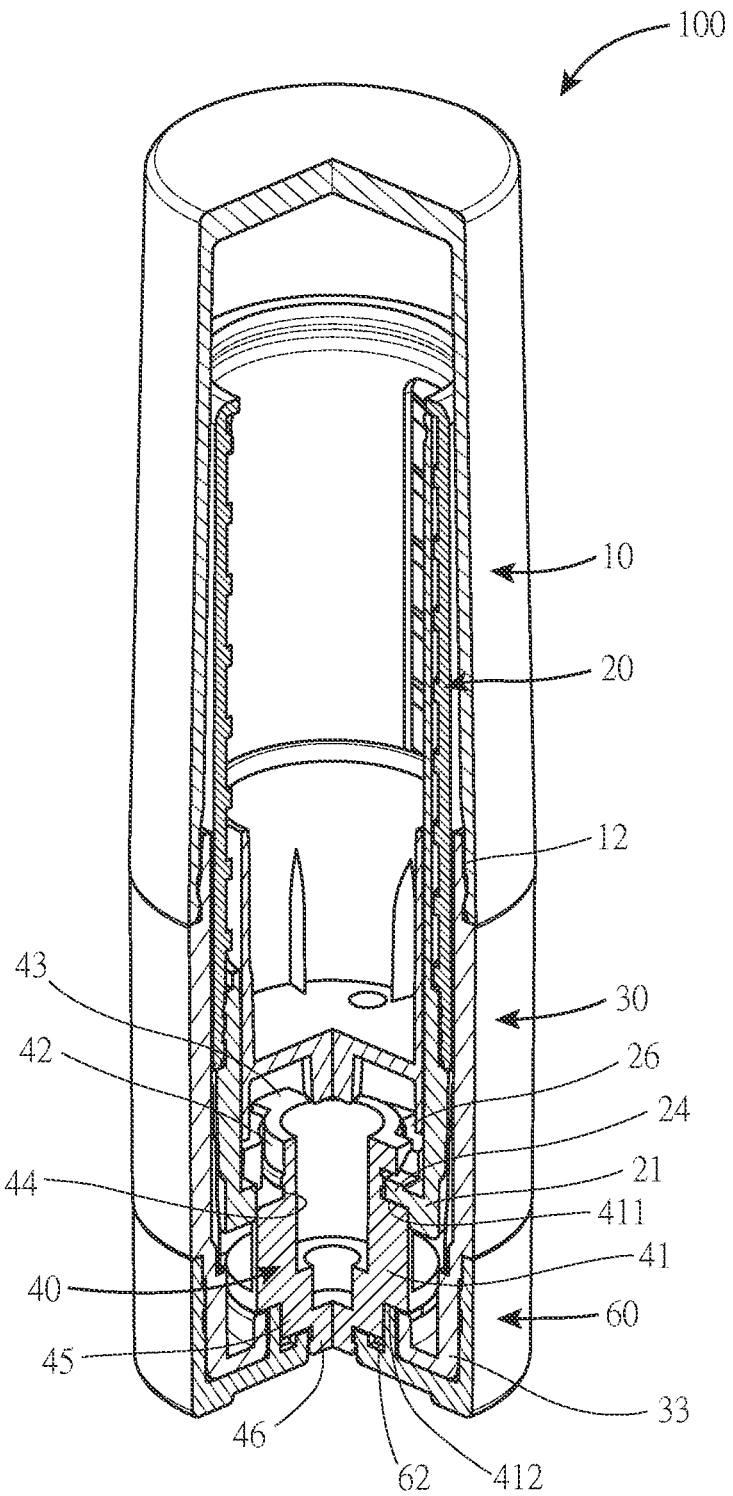
FIG. 1 is a longitudinal sectional view of a first embodiment of a lipstick container of the invention.
Figure 2:
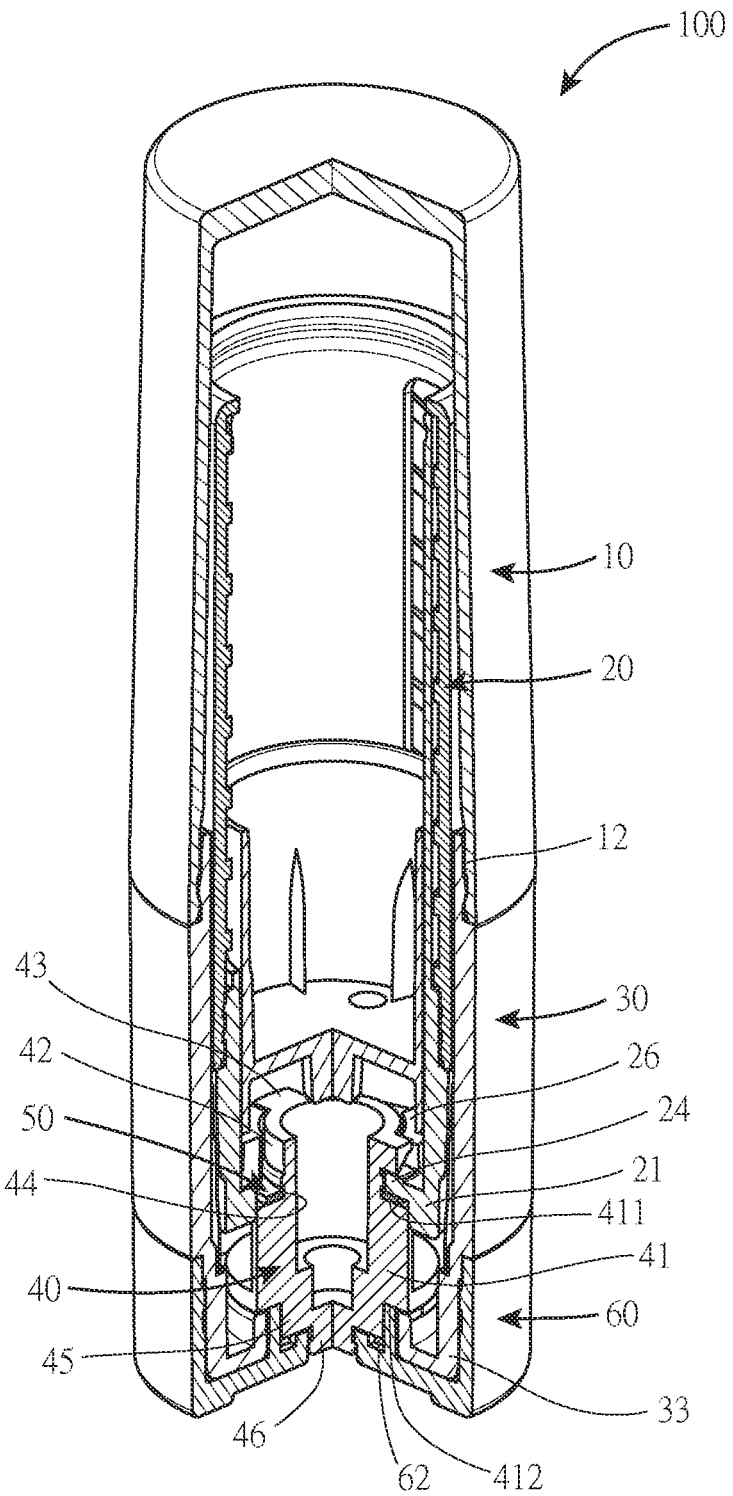
FIG. 2 is a longitudinal sectional view of a second embodiment of the lipstick container of the invention.
Figure 4:
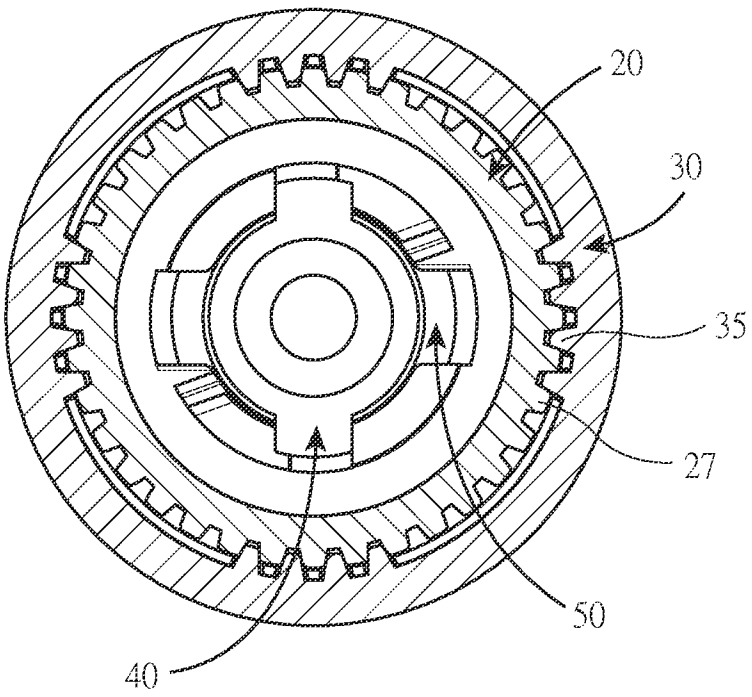
FIG. 4 is a sectional view the second embodiment of taken along line 4-4 of FIG. 3.
Figure 3:
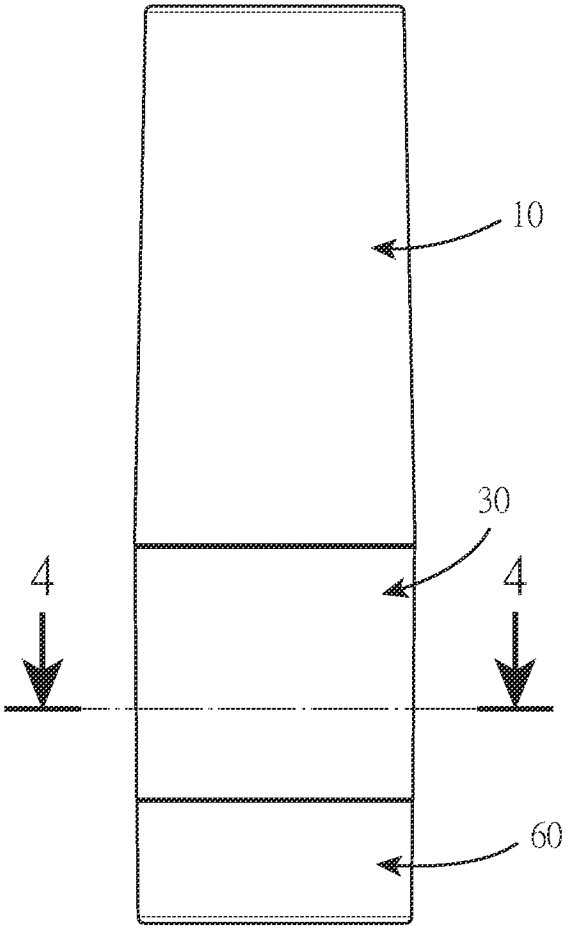
FIG. 3 is a side elevation of the second embodiment of the lipstick container.

Referring to FIGS. 1 to 6, a lipstick container 100 in accordance with the invention comprises the following components as discussed in detail below.

A cylindrical cap 10 includes an internal space 11 and a plurality of grooves 12 on an inner surface adjacent to its opening.

A cylindrical lipstick carrier 20 is partially disposed in the space 11 and includes a rotational seat 21 at an end distal the cap 10, two opposite cuts 22 at an edge of the rotational seat 21, a snapping hole 23 axially disposed in the rotational seat 21, two opposite, curved snapping members 24 disposed between an edge of the snapping hole 23 and the rotational seat 21, two recesses 25 each disposed between the snapping members 24 and aligned with the cut 22, two axial projecting members 26 each formed with the snapping member 24 and adjacent to the recess 25, and a plurality of ridges 27 formed on an outer surface of the rotational seat 21. A distance of the recesses 25 is less than that of the cuts 22 and greater than a diameter of the snapping hole 23.

A cylindrical joining device 30 includes an axial well 31, a plurality of end projections 32 equally spaced apart on an outer surface of an end of the joining device 30 and distal the well 31, the projections 32 being configured to secure to the grooves 12 by snapping, an annular protrusion 33 at an end of the joining device 30 opposite to the projections 32, a recessed member 34 in the protrusion 33, and a plurality of longitudinal troughs 35 on an inner surface of the joining device 30 adjacent to the protrusion 33. The troughs 35 are configured to secure to the ridges 27 by snapping.

A locking device 40 includes a seat 41 having a first annular surface 411 at one end urging against an inner surface of the rotational seat 21 and a second annular surface 412 at the other end urging against an inner surface of the protrusion 33; a plurality of equally spaced ribs 413 disposed between the first annular surface 411 and the second annular surface 412 to support the first annular surface 411 and the second annular surface 412; an axial shaft 42 extending from a center of the first annular surface 411 into the well 31 of the joining device 30; two opposite protuberances 43 radially extending from an outer surface of the shaft 42 and urging against the projecting members 26 of the lipstick carrier 20 respectively; an annular groove 44 formed between the protuberances 43 and the first annular surface 411 a toothed member 45 formed on the second annular surface 412; and an axial projecting element 46 extending from a center of the toothed member 45. A distance of the protuberances 43 is less than that of the recesses 25.

A cylindrical base 60 includes a grooved member 61 on an inner surface urging against an outer surface of the protrusion 33, a toothed element 62 on a central portion of a bottom and being in gear engagement with the toothed member 45 and urging against the second annular surface 412, and an axial through hole 63 disposed through both an end of the base 60 and the toothed element 62 with the projecting element 46 disposed therein.

The difference between a first embodiment and a second embodiment is that the second embodiment further comprises a washer 50 disposed on the annular groove 44 of the locking device 40, engaged with the first annular surface 411, and urging against the snapping members 24 of the lipstick carrier 20.

Figure 8:
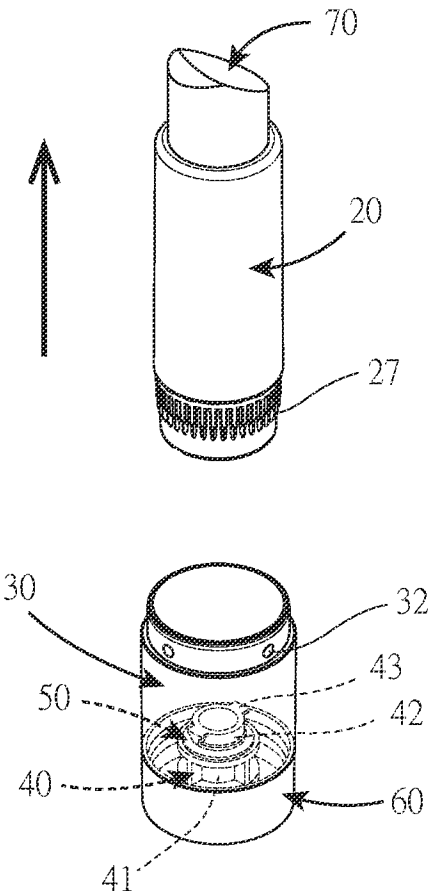
FIG. 8 is an exploded, perspective view showing the second embodiment of the lipstick carrier removed from the joining device and the locking device.
Figure 7:
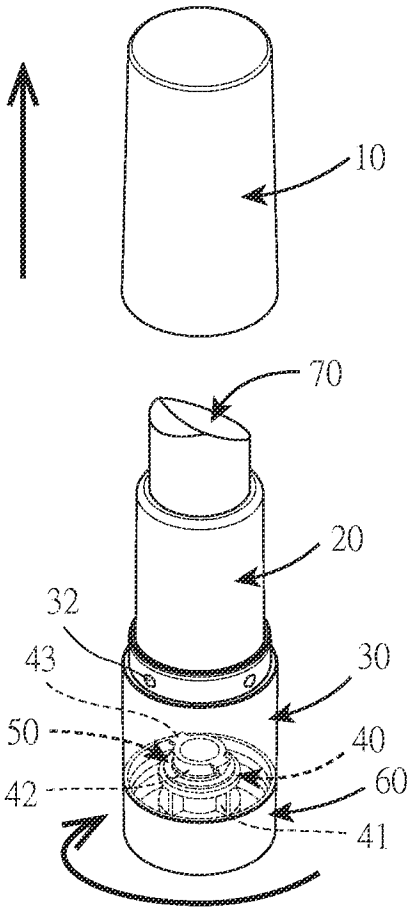
FIG. 7 is an exploded, perspective view showing the second embodiment of the lipstick container being opened and the base being rotated.
Figure 9:
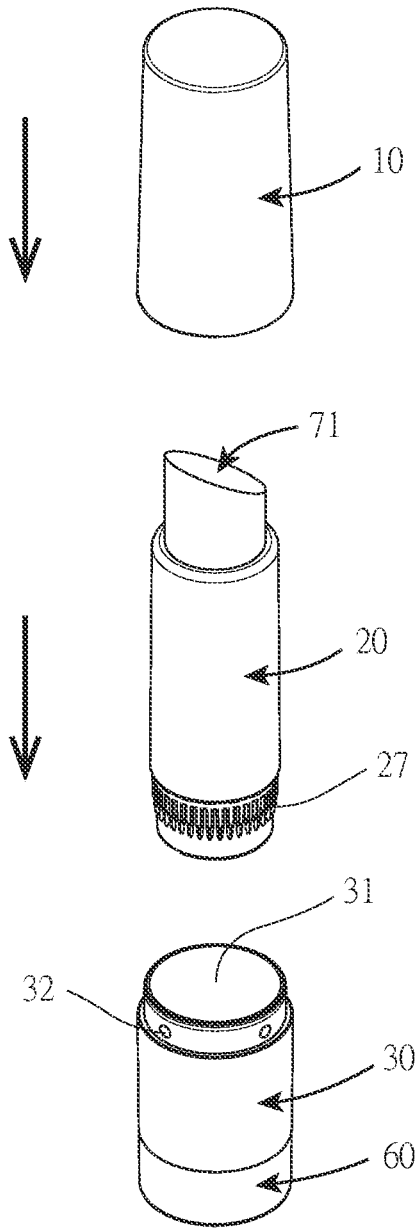
FIG. 9 schematically shows the consumed lipstick having been replaced by a new lipstick and to be fitted together with the joining device, the base and the cap.

Referring to FIGS. 7 to 9 in conjunction with FIG. 5, a replacement of a lipstick is discussed in detail below. Firstly, a user may remove the cap 10 out of the joining device 30 to expose a consumed lipstick 70 mounted on the lipstick carrier 20. Secondly, the user may hold the joining device 30 and rotate the base 60 so as to rotate the locking device 40. Thus, the protuberances 43 move from a position engaging the projecting members 26 to a position in the recesses 25. The lipstick carrier 20 is unlocked. Thirdly, the user may lift the lipstick carrier 20 to disengage it from both the locking device 40 and the well 31. Finally, the user may replace the consumed lipstick 70 with a new one.

Figure 5:
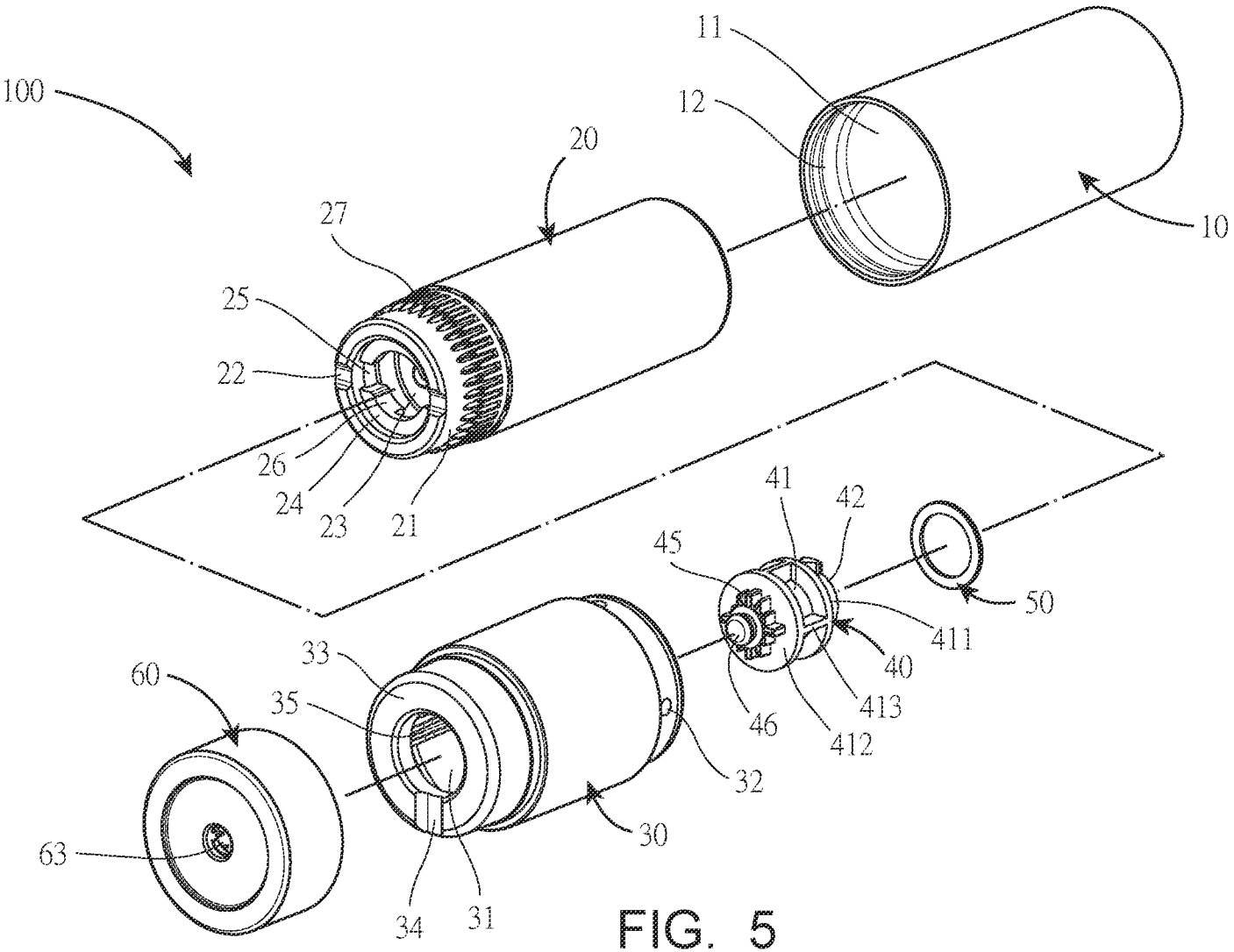
FIG. 5 is an exploded view of the second embodiment of the lipstick container.
Figure 6:
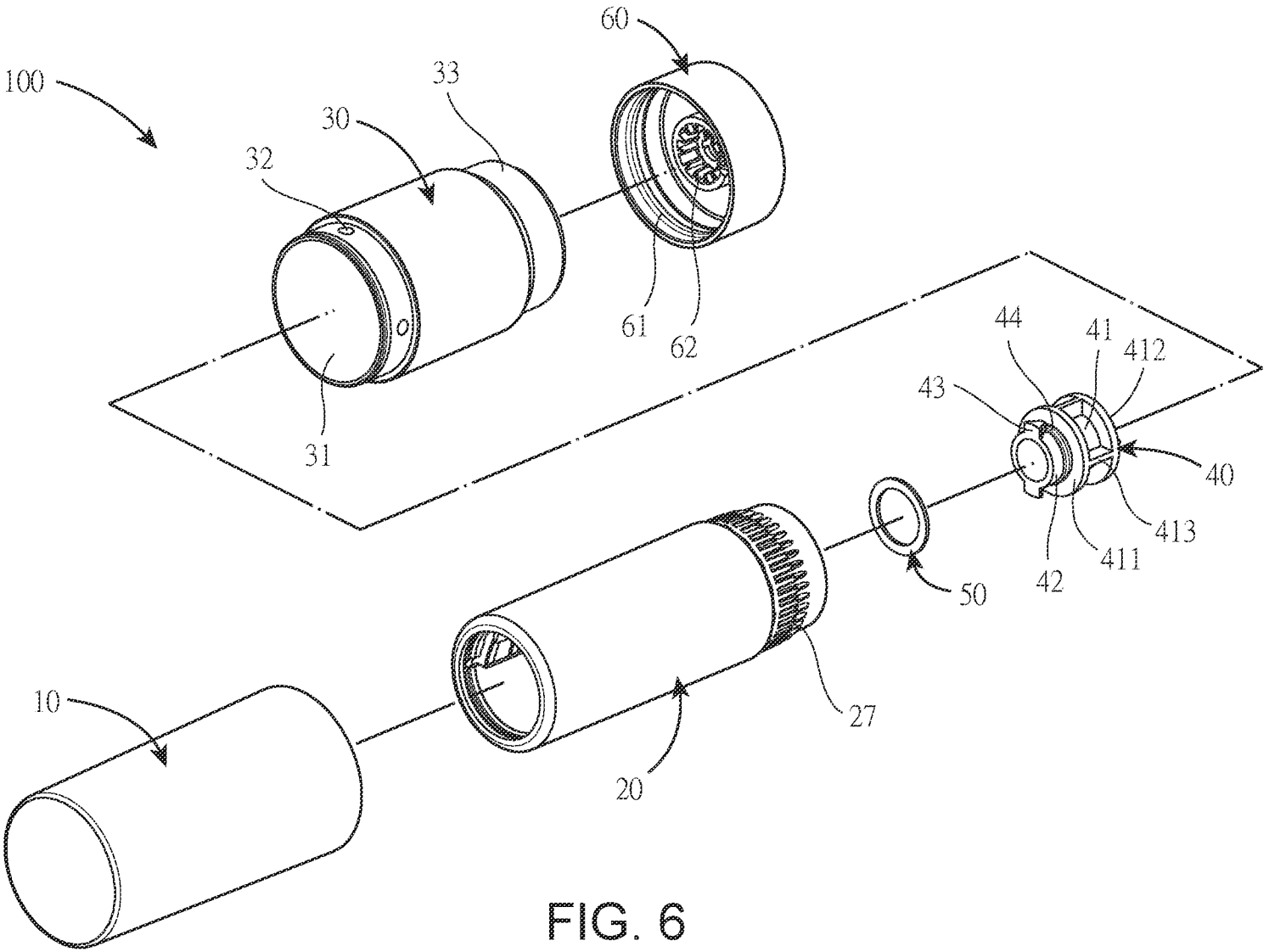
FIG. 6 is another exploded view of the second embodiment of the lipstick container.

Referring to FIG. 9 in conjunction with FIGS. 5 to 6, the lipstick carrier 20 having a newly mounted lipstick 71 is ready to fasten in the well 31. After the lipstick carrier 20 has been fastened, the shaft 42 is disposed in the snapping hole 23 with the protuberances 43 positioned in the recesses 25 respectively and the snapping members 24 urging against the washer 50. Next, the user may counterclockwise rotate the base 60 until the protuberances 43 are locked by the projecting members 26 respectively and an edge of the first annular surface 411 urges against the inner surface of the rotational seat 21. As such, the lipstick carrier 20 is locked by the locking device 40. Finally, the user may put the cap 10 onto the joining device 30 to complete the lipstick replacement of the lipstick carrier 20. Only the consumed lipstick of the lipstick carrier 20 is replaced rather than discarding the lipstick container. In other words, the lipstick container of the invention is reusable and environment friendly and does not harm the environment.

Following are noted. The washer 50 is disposed on the annular groove 44 and is engaged with the first annular surface 411. The washer 50 urges against the snapping members 24 so that the locking device 40 can increase tightness with the lipstick carrier 20 when the lipstick carrier 20 is rotated. Otherwise, the lipstick carrier 20 may be loosened. With the provision of the washer 50, the snapping members 24 do not contact the seat 41. This arrangement can decrease wear of both the lipstick carrier 20 and the locking device 40, increase the times of the lipstick replacement, and prolong the useful life of the lipstick carrier 20.

Following are further noted. The toothed element 62 is gear engagement with the toothed member 45 and the projecting element 46 is disposed in the through hole 63. Thus, the locking device 40 and the base 60 are secured together. This is contrast to the conventional art which has its locking device 40 and the base 60 formed integrally by means of ultrasonic welding or adhesive. This arrangement not only greatly decreases the manufacturing cost but also increases the production efficiency.

While the invention has been described in terms of preferred embodiments, those skilled in the art will recognize that the invention can be practiced with modifications within the spirit and scope of the appended claims.

What is claimed is:

1. A lipstick container with replaceable lipstick, comprising:

a cap including an internal space and a plurality of grooves on an inner surface adjacent to its opening;

a lipstick carrier partially disposed in the internal space and including a rotational seat at an end distal the cap, a snapping hole axially disposed in the rotational seat, two opposite snapping members disposed between an edge of the snapping hole and the rotational seat, two recesses each disposed between the snapping members, two axial projecting members each formed with the snapping member and adjacent to the recess, and a plurality of ridges formed on an outer surface of the rotational seat;

a joining device including an axial well, a plurality of end projections spaced apart on an outer surface of an end of the joining device, the projections being configured to secure to the grooves, an annular protrusion at an end of the joining device opposite to the projections, and a plurality of longitudinal troughs on an inner surface of the joining device adjacent to the protrusion, the troughs being configured to secure to the ridges;

a locking device including a seat having a first annular surface at one end and a second annular surface at the other end; an axial shaft extending from the first annular surface and disposed through the well of the joining device; two opposite protuberances radially extending from an outer surface of the shaft and urging against the projecting members of the lipstick carrier respectively; a toothed member formed on the second annular surface; and an axial projecting element extending from the toothed member; and a base including a grooved member on an inner surface urging against an outer surface of the protrusion, a toothed element on a bottom and being in gear engagement with the toothed member and urging against the second annular surface, and an axial through hole disposed through both an end of the base and the toothed element with the projecting element disposed therein.

2. The lipstick container of claim 1, wherein an annular groove is formed between the protuberances and the first annular surface.

3. The lipstick container of claim 2, further comprising a washer disposed on the annular groove, engaged with the first annular surface, and urging against the snapping members.

4. The lipstick container of claim 3, wherein the first annular surface urges against an inner surface of the rotational seat, and the second annular surface urges against an inner surface of the protrusion, further comprising a plurality of spaced ribs disposed between the first annular surface and the second annular surface.

5. The lipstick container of claim 3, further comprising two opposite cuts at an edge of the rotational seat, and a distance of the recesses from an axial center of the lipstick carrier being less than that of the cuts.

6. The lipstick container of claim 3, further comprising a recessed member in the protrusion.

7. The lipstick container of claim 1, wherein the first annular surface urges against an inner surface of the rotational seat, and the second annular surface urges against an inner surface of the protrusion, further comprising a plurality of spaced ribs disposed between the first annular surface and the second annular surface.

8. The lipstick container of claim 1, further comprising two opposite cuts at an edge of the rotational seat, and a distance of the recesses from an axial center of the lipstick carrier being less than that of the cuts.

9. The lipstick container of claim 1, further comprising a recessed member in the protrusion.

* * * * *